US009172179B2

(12) United States Patent
Starke et al.

(10) Patent No.: US 9,172,179 B2
(45) Date of Patent: Oct. 27, 2015

(54) CABLE CONNECTION COMPONENT

(75) Inventors: Cord Starke, Blomberg (DE); Valeri Reimchen, Steinheim/Sandebeck (DE)

(73) Assignee: Phoenix Contact GmbH & Co, KG, Blomberg (DE)

( * ) Notice: Subject to any disclaimer, the term of this patent is extended or adjusted under 35 U.S.C. 154(b) by 0 days.

(21) Appl. No.: 14/233,917

(22) PCT Filed: Jul. 11, 2012

(86) PCT No.: PCT/EP2012/002915
§ 371 (c)(1),
(2), (4) Date: Jan. 21, 2014

(87) PCT Pub. No.: WO2013/010648
PCT Pub. Date: Jan. 24, 2013

(65) Prior Publication Data

US 2014/0179149 A1 Jun. 26, 2014

(30) Foreign Application Priority Data

Jul. 21, 2011 (DE) ..... 10 2011 108 123

(51) Int. Cl.
*H01R 13/58* (2006.01)
*H01R 13/622* (2006.01)
*H01R 4/24* (2006.01)
(Continued)

(52) U.S. Cl.
CPC ..... *H01R 13/622* (2013.01); *H01R 4/2433* (2013.01); *H01R 13/512* (2013.01); *H01R 13/59* (2013.01)

(58) Field of Classification Search
CPC .. H01R 13/622; H01R 4/2433; H01R 4/2408; H01R 13/59; H02G 3/088; H02G 3/065; H02G 3/0691; H02G 3/22; H02G 3/0683; F16L 37/0925
USPC ..... 439/320, 404, 411–414, 462; 174/652, 174/655–657, 665, 152 G, 153 G; 285/158, 285/323
See application file for complete search history.

(56) References Cited

U.S. PATENT DOCUMENTS 5,350,204 A * 9/1994 Henniger ..... 285/323
5,573,423 A * 11/1996 Lin et al. ..... 439/462
(Continued)

FOREIGN PATENT DOCUMENTS

DE 198 36 622 A1 3/2000
DE 199 51 455 C1 10/2001
(Continued)

*Primary Examiner* — Thanh Tam Le
(74) *Attorney, Agent, or Firm* — Roberts Mlotkowski Safran & Cole, PC

(57) ABSTRACT

A cable connection component for electrically conductively connecting a cable, having a union nut with an internal thread and a core receiving and guiding part with a plurality of incisions. At least one core and core insulation inserted into the core receiving and guiding part are severed by terminals arranged in the connection body and enter the incisions in the core receiving and guiding part and contact is made with the core conductors when a first thread of the union nut is screwed onto a connection body. A connected cable can be released with less effort by the union nut having a second internal thread with a thread pitch that is less than the thread pitch of the first internal thread. The core receiving and guiding part has a radially running collar which is matched to the profile of the threading of the second internal thread and interacts with it.

10 Claims, 4 Drawing Sheets

(51) Int. Cl.
*H01R 13/512* (2006.01)
*H01R 13/59* (2006.01)

(56) References Cited

U.S. PATENT DOCUMENTS 5,920,035 A * 7/1999 Haney et al. ..... 174/652
5,989,056 A 11/1999 Lange et al.
6,268,565 B1 * 7/2001 Daoud ..... 174/657
6,403,884 B1 * 6/2002 Lange ..... 174/653
6,409,179 B1 * 6/2002 Daoud ..... 277/602
6,521,832 B2 * 2/2003 Lange ..... 174/657
7,467,978 B2 * 12/2008 Sundermeier ..... 439/690
8,766,109 B2 * 7/2014 Duval et al. ..... 174/659
8,790,128 B2 * 7/2014 Andresen ..... 439/404

FOREIGN PATENT DOCUMENTS

DE 100 22 547 A1 11/2001
DE 103 29 772 A1 3/2005

* cited by examiner

CABLE CONNECTION COMPONENT

BACKGROUND OF THE INVENTION

1. Field of the Invention

The invention relates to a cable connection component for electrically conductive connection of a cable, with a union nut which has an internal thread and with a core receiving and guide part which has several notches, the cable having at least one core, and the core insulation of the core ends which have been inserted into the core receiving and guide part being severed by insulation piercing connecting devices which dip into the notches in the core receiving and guide part and which are located in the connection body and make contact with the conductors of the cores when the union nut is being screwed onto a connection body which is provided with an external thread which corresponds to the internal thread. Moreover, the invention relates to a cable connection apparatus and a cable joining apparatus with a cable connection component and a device connection component or a cable joining component.

2. Description of Related Art

German Patent DE 199 51 455 C1 and corresponding U.S. Pat. No. 6,403,884 B1 disclose a cable connection component as part of a cable connection apparatus with which the cores of a multicore cable can be easily connected to the connection elements of a device connection component or a cable joining component without the insulation of the individual cores having to be removed beforehand. In the cable connection component which is described for example in FIG. 6 of DE 199 51 455 C1 and corresponding U.S. Pat. No. 6,403,884 B1, the individual cores of the cable are first inserted into the core receiving and guide part, which is often also called a splice part or splice ring. Then, the core ends are bent and inserted into recesses in the core receiving and guide part which are used as retaining catches for the cores during radial deflection. Then, the core ends protruding through the recesses are cut off so that the union nut can be screwed onto the corresponding external thread of the connection body. When the union nut is being screwed onto the connection body, the insulation piercing connecting devices which are located in the connection body penetrate into the notches which are provided in the core receiving and guide part, the insulation piercing connecting devices penetrating the core insulation of the individual cores which cross the notches and make contact with the individual conductors.

Cable connection or joining apparatus with this structure which are basically already known from German Utility Model DE 295 12 585 U1 and corresponding U.S. Pat. No. 5,989,056 as well as from German Patent DE 198 36 662 C2 have proven themselves to an extraordinary degree in practice for more than ten years and are extensively marketed by Phoenix Contact GmbH & Co under the product name QUICKON in various embodiments (compare brochure "PLUSCON 2011" pages 8 and 9 and pages 92 and 93, of Phoenix Contact GmbH & Co KG, Blomberg).

In the cable connection apparatus known from German Utility Model DE 295 12 585 U1 and corresponding U.S. Pat. No. 5,989,056, the union nut and the core receiving and guide part are two individual parts which are not connected to one another. A rigid connection is not allowable because the core receiving and guide part may not or cannot turn when the union nut is being screwed onto the connection body. The unrealized connection of the union nut and the core receiving and guide part leads to the cable at first remaining connected or joined when the connection is broken after unscrewing the union nut from the connection body, because the insulation piercing connecting devices of the connection body are still "holding" onto the clamped conductors. Therefore, to break the connection after unscrewing the union nut from the connection body an additional disconnection of the conductors which are held by the insulation piercing connecting devices is necessary; this is associated with a considerable expenditure of force.

In the cable connection apparatus according to German Patent DE 199 51 455 C1 and corresponding U.S. Pat. No. 6,403,884 B1, this problem is solved by the core receiving and guide part being axially fixed via a slotted, elastic snap ring in the union nut, the core receiving and guide part being able to turn in the axially fixed position relative to the union nut. This has the advantage that the axial relative motion between the union nut and the connection body which accompanies the unscrewing of the union nut from the connection body at the same time causes a corresponding axial relative movement between the splice part and the connection body which leads to the conductors being pulled out of the insulation piercing connecting devices.

This fixing of the core receiving and guide part in the union nut, in addition to the above described advantage, however, also has certain disadvantages, especially when an electrical cable is being disconnected again and pulled out of the cable connection component. Especially when the core receiving and guide part, as is conventional in practice, also has a tension relief and sealing region in addition to the actual core guidance region, there is the risk that, due to the formation of the tension relief and sealing region and its intentional interaction with the union nut, pulling the electrical cable out of the cable connection component becomes more difficult due to the fixing of the core receiving and guide part in the union nut.

German Application DE 103 29 772 B4 discloses a cable connection apparatus in which fixing of the core receiving and guide part in the union nut has been consciously omitted. The resulting "disadvantage" that, when the connection is broken after unscrewing the union nut from the connection body, the cable first remains still connected because the contact elements of the clamping and connection unit are still "holding" onto the clamped conductors, is compensated in that a support and retaining element is made on the connection body which extends in the axial direction and with a radial distance to the external thread of the connection body, which element is used as an abutment for a tool with which the splice part can be levered out of the connection body. In order to avoid damage on the core receiving and guide part, a groove as an action section for a tool is provided externally on the core receiving and guide part.

In the cable connection apparatus which is known from German Patent DE 103 29 772 B4, first of all, it is disadvantageous that the execution of the support and retaining element on the connection body is associated with additional production effort. Moreover, under restricted installation conditions, mechanical sticking of adjacent components or of a cable on the projecting support and retaining element can occur. Finally, to lever the splice part out of the connection body, an additional tool is necessary; this makes handling difficult.

SUMMARY OF THE INVENTION

The initially described cable connection component in which the aforementioned problem is solved, specifically a cable once connected can be detached again with little effort, is characterized in that the union nut has a second internal thread, the thread pitch $I_1$ of the first internal thread being greater than the thread pitch $I_2$ of the second internal thread and that the core receiving and guide part has a radially running collar which in its shape is matched to the thread profile of the second internal thread and interacts with it.

In the cable connection component in accordance with the invention, the union nut thus has two internal threads with different pitches, the coarser thread interacting with the external thread of the connection body and the finer thread interacting with the collar of the core receiving and guide part. In this way, when the union nut is being detached from the external thread of the connection body an axial relative motion arises between the connection body and the core receiving and guide part so that the core receiving and guide part is pulled out of the connection body at the same time when the union nut is being loosened. With the core receiving and guide part being pulled out, the cores are also pulled out of the insulation piercing connecting devices. The path which the core receiving and guide part traverses per revolution of the union nut corresponds to the pitch difference between the first internal thread and the second internal thread.

Fundamentally, the collar which protrudes radially on the core receiving and guide part could extend by more than 360° so that the collar itself forms an external thread which corresponds to the second internal thread. Since the collar on the core receiving and guide part—different from the external thread on the connection body—is used, not for secure fixing of the union nut on the core receiving and guide part, but only for entraining the core receiving and guide part when the union nut is being unscrewed, it is sufficient if the collar extends by less than 360° or is formed of at least two sections which are located with a radial distance to one another.

It was stated above that the union nut has two internal threads with different thread pitches. Fundamentally, it is possible for the union nut to have a two-start thread, and the two internal threads thus overlap over their entire length or in any case a large part of their length. During installation, first the core receiving and guide part is screwed a distance into the union nut, the collar being guided in the second, finer internal thread. When the union nut is then being screwed onto the external thread of the connection body, then the first, coarser internal thread is screwed onto the external thread and at the same time the core receiving and guide part with the collar is screwed further into the second internal thread.

Since the above described execution of the two-start thread in the union nut can only be produced with relative complexity at smaller diameters of the union nut, according to a preferred configuration of the invention, the second internal thread in the screw-down direction is located, at least in part, behind the first internal thread which corresponds to the external thread of the connection body. This means that only the second, finer internal thread is made at least in the region of the union nut which is behind in the screw-down direction. Preferably, at smaller diameters of the union nut, for example, for M8 or M12 circular connectors, a two-start thread is omitted so that the second internal thread is located completely behind the internal thread in the screw-down direction.

The shape of the collar on the core receiving and guide part must be executed such that, on the one hand, it is matched to the thread profile of the second internal thread, and on the other hand, it also enables the core receiving and guide part to be screwed into the first internal thread. When the core receiving and guide part and the union nut are joined together, the collar must first be turned through the first internal thread of the union nut as far as its end. In doing so the collar, and thus, also the core receiving and guide part assume an axial slant according to the thread pitch of the first internal thread, which slant however does not seriously inhibit the core receiving and guide part from being screwed in. When the collar engages the second internal thread of the union nut, the core receiving and guide part is automatically axially aligned again.

The joining together of the core receiving and guide part with the union nut can be further simplified according to another configuration in that the first internal thread has a larger diameter than the second internal thread so that the nominal diameter of the first internal thread is greater than the outside diameter of the collar. This yields the advantage that, when the core receiving and guide part is being installed in the union nut, the collar need not be screwed through the first, coarser internal thread.

It was stated above that an axial relative movement of the core receiving and guide part to the connection body takes place by the execution of the two internal threads when the union nut is being unscrewed from the external thread of the connection body so that the core receiving and guide part is pulled out of the connection body. The execution of the two internal threads with the different pitches however has not only the above described advantage when the union nut is being unscrewed, but moreover, also has an advantage when the union nut is being screwed on, i.e., during interconnection. The two internal threads, specifically when the union nut is being screwed down, cause a reduction of the axial motion of the core receiving and guide part so that the screwing-down of the union nut and the associated pushing of the cores into the insulation piercing connecting devices can take place with little expenditure of force. Thus, cables with four or more cores can be connected by hand; this was hardly possible in the past.

In the cable connection component in accordance with the invention, preferably, the first internal thread, the second internal thread and the collar are made and arranged on the core receiving and guide part such that, when the first internal thread has been completely unscrewed from the external thread of the connection body, the collar still engages the second internal thread. This configuration leads to the fact that, after unscrewing the union nut from the connection body, when the union nut is being pulled off, the core receiving and guide part which has already been partially pulled out is automatically completely pulled out of the connection body. Thus, the core receiving and guide part need not be additionally and separately pulled out of the connection body after unscrewing the union nut from the external thread of the connection body.

The aforementioned dimensioning of the first internal thread and second internal thread can be achieved, for example, by the length $I_1$ of the first internal thread being greater than the length $I_2$ of the second internal thread, and by the length of the second internal thread $I_2$ being greater than the difference between the length $I_1$ of the first internal thread and the length $I_2$ of the second internal thread. Preferably, the first internal thread and the second internal thread have the same number of thread crests. The aforementioned dimensioning principle can thus easily result in that, when the first internal thread has already been completely unscrewed from the external thread of the connection body, the collar on the core receiving and guide part still engages the second internal thread so that the core receiving and guide part is also pulled out of the connection body at the same time as removal of the union nut.

In addition to the above described cable connection component, the invention also relates to a cable connection apparatus for electrically conductive connection of a cable to an electrical device. Here, an electrical device should quite generally be understood as electrical components, apparatus and devices. The electrical device can be, for example, a lamp or lamp bowl, a fan, a heat radiator or also a sensor/actuator box.

This cable connection apparatus, in addition to the above described cable connection component, has a device connection component which has a connection body with an external thread which corresponds to the first internal thread. In the connection body, there is a clamping and connection unit which has insulation piercing connecting devices and connection elements. The insulation piercing connecting devices are located on the side facing the cable connection component and the connection elements are located on the side facing away from the cable connection component. Generally, they are metal parts which are executed in one piece and which are made on one side as insulation piercing connecting devices and on the other side as connection elements. The connection elements can, in turn, be made preferably as pin contacts or jacks.

Finally, this invention relates to a cable joining apparatus for the electrically conductive joining of two cables. This cable joining apparatus which is also often called a line connector, in addition to a cable connection component in accordance with the invention, has a cable joining component. The cable joining component has a connection body with an external thread which corresponds to the first internal thread of the union nut and a clamping and terminal unit with insulation piercing connecting devices and with connection elements. In the same manner as in the clamping and connection unit of the device connection component, in the clamping and connection unit of the cable joining component, the insulation piercing connecting devices are located on the side facing the cable connection component and the connection elements are located on the opposite side.

For the connection elements which are used for connection of the cores of the second cable, fundamentally, the connection techniques known from the prior art can be used, for example, screw connection or spring force clamping connection. However, preferably, the connection elements are made as insulation piercing connecting devices so that, in the clamping and connection unit of the cable joining component, several metal parts are formed which are made as insulation piercing connecting devices on both sides. In this case, the connection body then has a second external thread so that on the second side of the connection body the union nut of a second cable connection component can be screwed down and thus a core receiving and guide part can be pushed into the connection body.

In particular, there are now various possibilities for configuring and developing the cable connection component in accordance with the invention as well as the cable connection apparatus and the cable joining apparatus. In this respect reference is made to the detailed description of a preferred exemplary embodiment in conjunction with the drawings.

DETAILED DESCRIPTION OF THE INVENTION

Figure 1B:
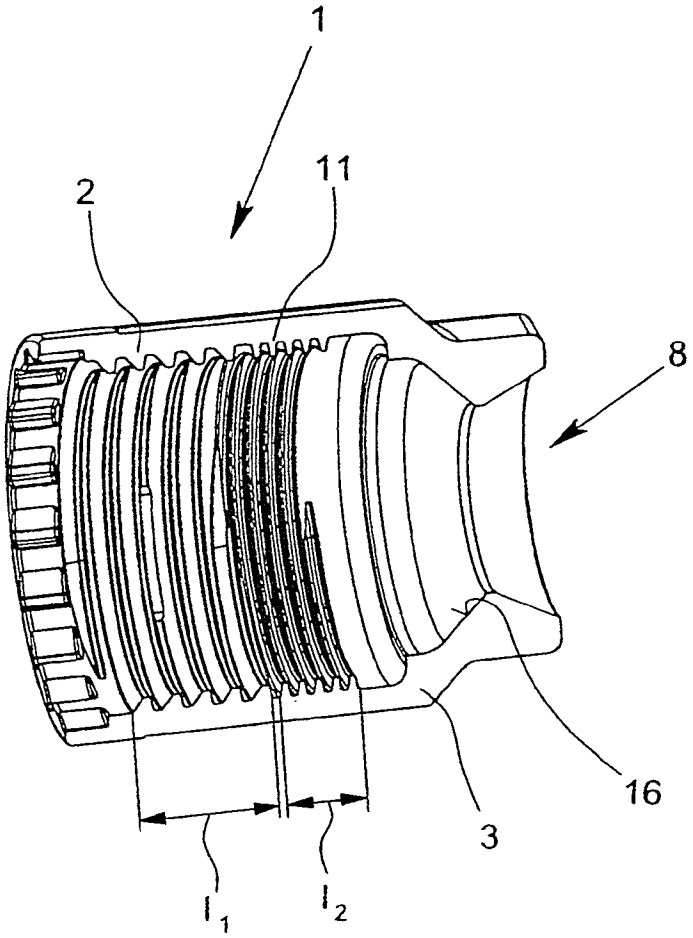
FIG. 1*a* is a perspective view of a cable connection component with a core receiving and guide part and FIG. 1*b* is a longitudinal sectional view of a separate union nut.
Figure 1A:
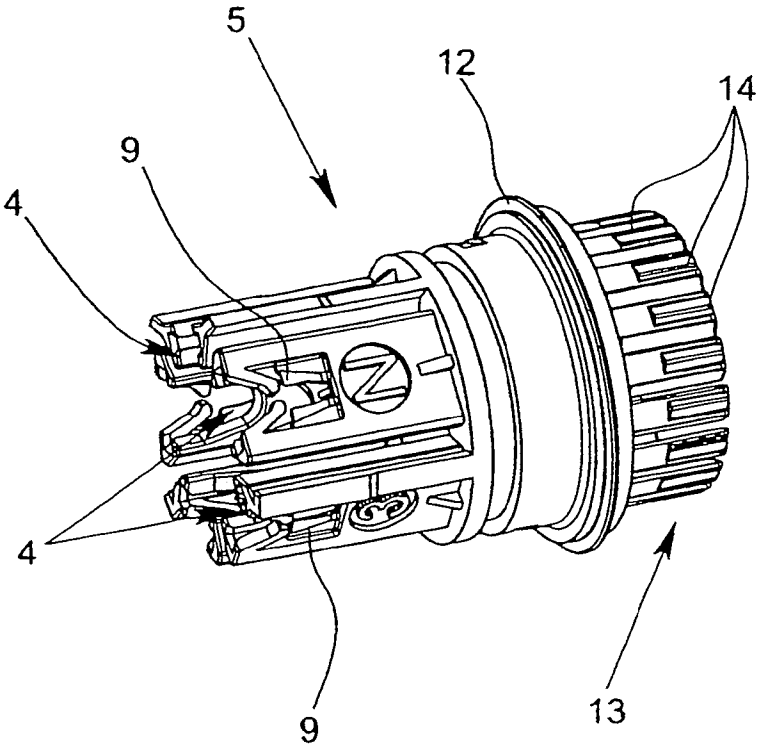
Figure 3:
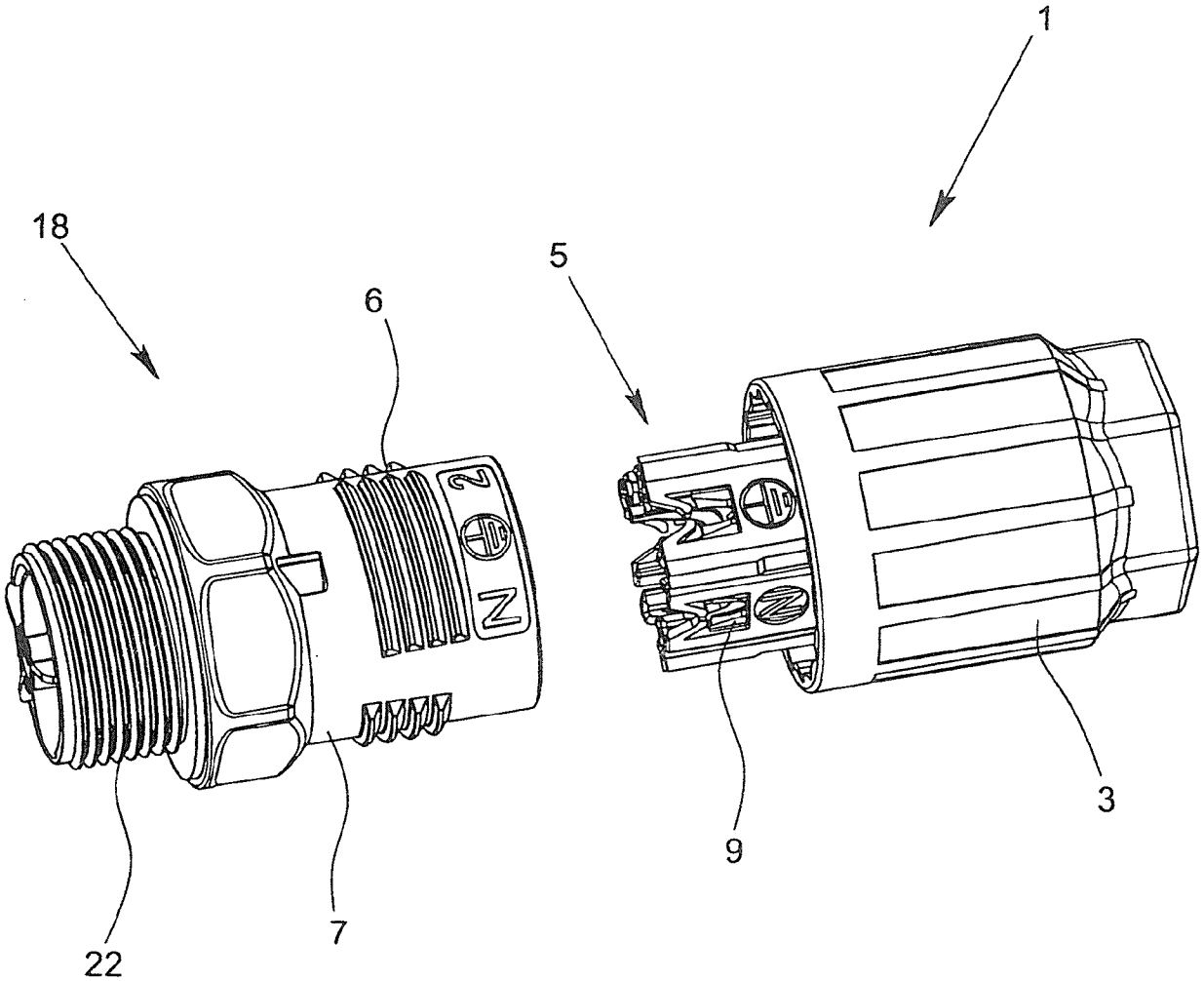
FIG. 3 shows a cable connection apparatus with a cable connection component and a device connection component in the not yet installed state.

FIG. 1*a* shows a cable connection component 1 in accordance with the invention which is composed of a union nut 3 with a first internal thread 2 and a core receiving and guide part 5 which has several notches 4. While in FIG. 1*b* the union nut 3 (which is shown in a longitudinal section) and the core receiving and guide part 5 are shown not connected to one another, FIG. 3 shows the assembled cable connection component 1 together with a connection body 7 which has an external thread 6, the external thread 6 being made corresponding to the first internal thread 2 of the union nut 3 so that the union nut 3 with the first internal thread 2 can be screwed onto the external thread 6 of the connection body 7.

For electrically conductive connection of a multicore cable (not shown) to the connection body 7, first the cable is guided into the cable connection component 1 by the end of the cable being pushed through the backward opening 8 in the union nut 3 into the core receiving and guide part 5 so far that the individual core ends on the end side facing away from the union nut 3 protrude out of the core receiving and guide part 5. Then, the individual core ends are folded to the outside, and in doing so, pressed into the recesses 9 which are used as retaining catches for the core ends. In this way, since the core ends cross the notches 4, when the union nut 3 is being screwed onto the connection body 7, the core ends are slit and then the conductors of the individual cores make contact with the insulation piercing connecting devices 10 which are located in the connection body 7. The insulation piercing connecting devices 10, in doing so, slide into the notches 4 which are open on the face side and which are made in the core receiving and guide part 5, as a result of which reliable contact-making of the core ends which have been folded to the outside and which cross the notches by the insulation piercing connecting devices 10 is ensured.

As is especially apparent from FIG. 1*b*, using the union nut 3, which is shown cutaway there, the union nut 3 has a second internal thread 11 in addition to the first internal thread 2. The second internal thread 11 is located behind the first internal thread 2 in the screw-down direction A (shown in FIG. 2*b*) and corresponds to the external thread 6 of the connection body 7. The first internal thread 2 and the second internal thread 11 have different thread pitches, the thread pitch $I_1$ of the first internal thread 2 being greater than the thread pitch $I_2$ of the second internal thread 11. In the illustrated preferred exemplary embodiment, the thread pitch $I_1$ of the first internal thread 2 is more than twice as great as the thread pitch $I_2$ of the second internal thread 11.

Figure 2A:
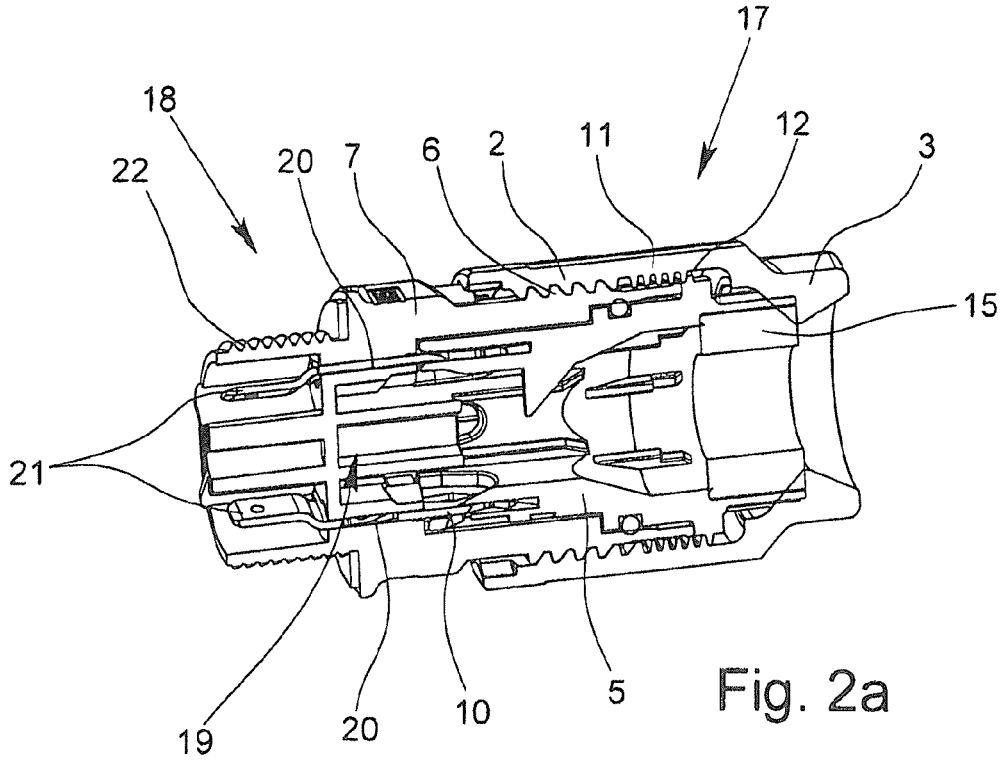
FIG. 2*a* is a longitudinal sectional view through a cable connection apparatus with the union nut screwed completely down and FIG. 2*b* is a view of the cable connection apparatus similar to that of FIG. 2*a*, but with the union nut loosened.
Figure 2B:
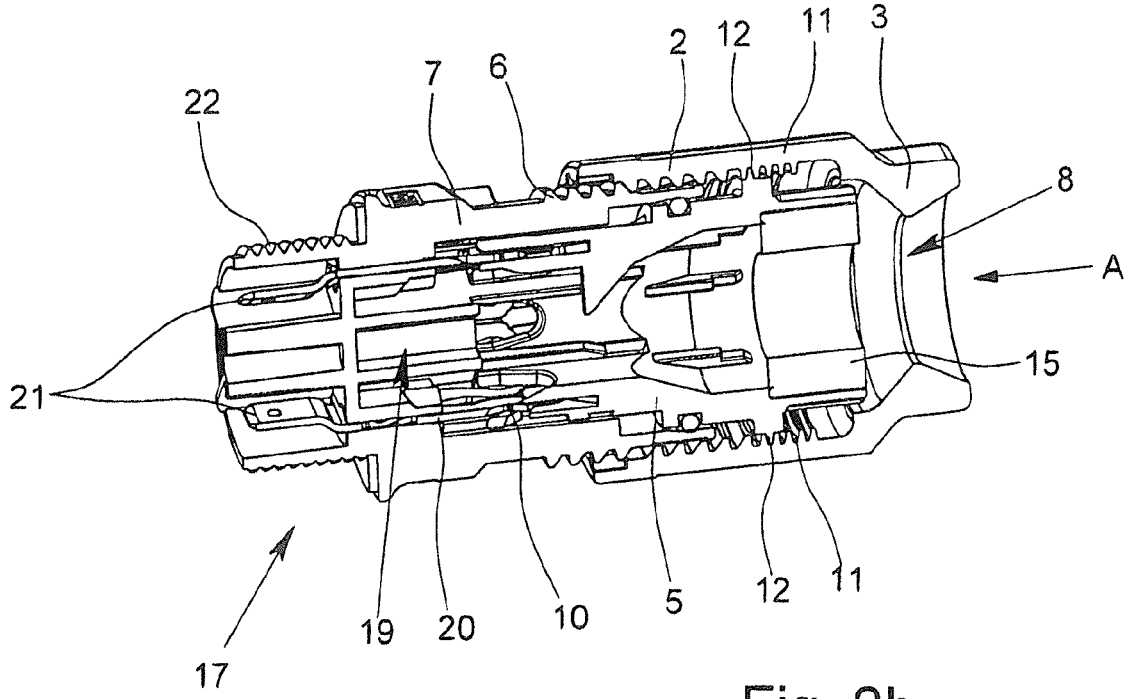

As is especially apparent from the representations according to FIGS. 2*a* & 2*b*, the second internal thread 11 interacts with a radially running collar 12 which is made on the core receiving and guide part 5 and which in its cross sectional shape is matched to the thread profile of the second internal thread 11. When the union nut 3 is being unscrewed and screwed onto the connection body 7, the first internal thread 2 interacts with the external thread 6, the second internal thread 11 interacts with the collar 12. When the union nut 3 is being unscrewed from the connection body 7, this results in an axial relative motion not only between the union nut 3 and the connection body 7, but also between the core receiving and guide part 5 and the connection body 7, as is apparent from a comparison of FIGS. 2*a* and 2*b*. When the union nut 3 is being unscrewed, the core receiving and guide part 5 is thus automatically pulled out of the connection body 7, as a result of which the core ends are pulled out of the insulation piercing connecting devices 10.

If the union nut 3, with its first internal thread 2, is completely unscrewed from the external thread 6 of the connection body 7, as is shown in FIG. 2*b*, by removing the union nut 3, at the same time, the core receiving and guide part 5 can be pulled out of the connection body 7. This is achieved by the length $I_1$ of the first internal thread 2, the length $I_2$ of the second internal thread 11 and the location of the collar 12 on the core receiving and guide part 5 being chosen such that, even if the first internal thread 2 has been completely unscrewed from the external thread 6 (FIG. 2*b*), the collar 12 still engages the second internal thread 11.

In the exemplary embodiment of the cable connection component 1 in accordance with the invention which is shown in FIGS. 2*a*, 2*b*, in which the first internal thread 2 and the second internal thread 11 have the same number of thread crests, so that the length $I_1$ of the first internal thread 2 is more than twice as great as the length $I_2$ of the second internal thread 11, the collar 12 is located on the core receiving and guide part 5 such that the difference between the length $I_1$ of the first internal thread 2 and the length $I_2$ of the second internal thread 11 is smaller than the length $I_2$ of the second internal thread 11.

The execution of a second internal thread 11 in the union nut 3, not only when the union nut 3 is being screwed off, has the above described advantage that the core receiving and guide part 5 is also automatically pulled out of the connection body 7, but also the advantage that the cable can be connected to the connection body 7 with less expenditure of effort. When the union nut 3 is being screwed onto the external thread 6 of the connection body 7, specifically by the second, finer internal thread 11, a reduction of the axial motion of the core receiving and guide part 5 into the connection body 7 is implemented. Because the second internal thread 11 has a smaller thread pitch $I_2$ than the first internal thread 2, the axial motion of the core receiving and guide part 5 into the connection body 7 per revolution of the union nut 3 is smaller than the thread pitch $I_1$ of the first internal thread 2. With each revolution of the union nut 3 the core ends which are located in the core receiving and guide part 5 are thus forced only a short distance into the insulation piercing connecting devices 10 in the connection body 7 so that the expenditure of force during connection is so small that even a cable with four or more cores can be connected by hand.

FIGS. 1*a*, 1*b* and 2*a*, 2*b* show that the core receiving and guide part 5, on the side opposite the recesses 9, has a tension relief and sealing region 13 which is formed of a plurality of annularly arranged plates 14 and a seal 15 which is located within the plates 14. When the union nut 3 is being screwed on, the plates 14 interact with a bevel 16 which is provided on the inside on the union nut 3 in the manner of a so-called PG union so that when the union nut 3 is being screwed onto the connection body 7, the plates 14 are pushed against the seal 15, as a result of which sealing and at the same time also tension relief of the inserted cable arise.

Figure 4:
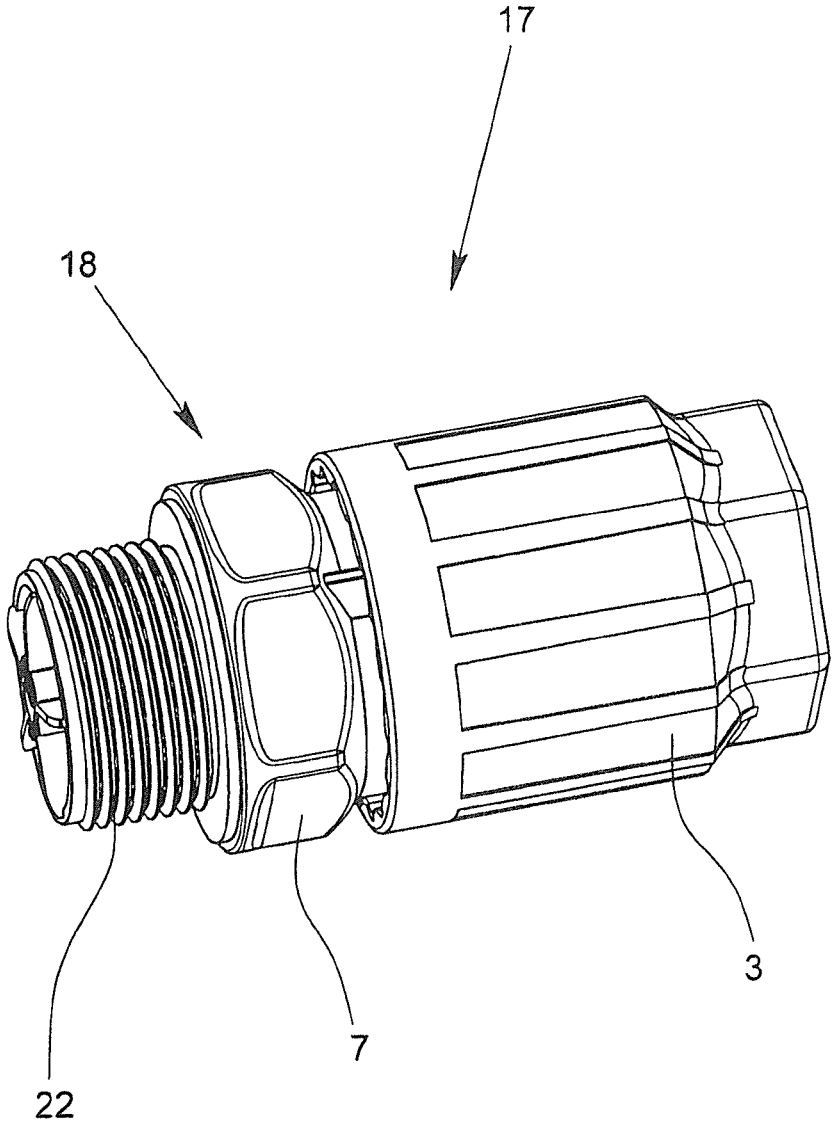
FIG. 4 shows the cable connection apparatus according to FIG. 3 in the screwed-together state.

The cable connection apparatus 17 which is shown in FIGS. 2 to 4 comprises a cable connection component 1 and a device connection component 18. The cable connection component 1 has a union nut 3 and a core receiving and guide part 5. The device connection component 18 comprises the connection body 7 and the clamping and connection unit 19 which is located in the connection body 7 and which has a number of metal parts 20 which corresponds to the number of cores which are to be connected. The individual metal parts 20 on the side facing the cable connection component 1 are made as insulation piercing connecting devices 10 and on the opposite side as connection elements 21 to which electrical lines can be connected, for example, by soldering.

In the exemplary embodiment of the cable connection apparatus 17 which is shown in the figures, the device connection component 18 is made as a wall penetration so that the connection body 7, on the side facing away from the cable connection component 1, still has a second external thread 22. The device connection component 18 can then be easily screwed with the external thread 22 into a corresponding thread on the housing wall and locked with a nut.

What is claimed is:

1. A cable connection component for electrically conductive connection of a cable having at least one core, comprising:

a union nut which has a first internal thread and a second internal thread, and a core receiving and guide part which has several notches, wherein the union nut can be screwed onto a connection body having an external thread which corresponds to the first internal thread of the union nut, wherein the first internal thread has a thread pitch that is greater than the thread pitch of the second internal thread, wherein the core receiving and guide part has a radially running collar with a shape that is matched to the thread profile of the second internal thread and interacts with the second internal thread, and wherein wherein the core receiving and guide part has a tension relief and sealing region which faces the union nut and which has several annularly arranged plates, and wherein the radially running collar is located on a side of the tension relief and sealing region which faces away from the union nut.

2. The cable connection component as claimed in claim 1, wherein the collar extends less than 360°.

3. The cable connection component as claimed in claim 1, wherein the first internal thread and the second internal thread at least partially overlap in a lengthwise direction of thereof.

4. The cable connection component as claimed in claim 1, wherein the second internal thread is located behind the first internal thread in a screw-down direction which corresponds to the external thread of the connection body.

5. The cable connection component as claimed in claim 4, wherein the first internal thread has a greater diameter than the second internal thread.

6. The cable connection component as claimed in claim 4, wherein the first internal thread, the second internal thread and the collar are made and arranged on the core receiving and guide part such that, when the first internal thread has been completely unscrewed from the external thread of the connection body, the collar is still able to engage the second internal thread on the core receiving and guide part.

7. The cable connection component as claimed in claim 6, wherein the first internal thread has a length $l_1$ that is greater than a length $l_2$ of the second internal thread, and wherein the length $l_2$ of the second internal thread is greater than a difference between the length $l_1$ of the first internal thread and the length $l_2$ of the second internal thread.

8. The cable connection component as claimed in claim 1, wherein the thread pitch of the first internal thread is at least twice as great as the thread pitch of the second internal thread.

9. A cable connection apparatus for electrically conductive connection of a cable to an electrical device, comprising:

a cable connection component having:

a union nut which has a first internal thread and a second internal thread, and a core receiving and guide part which has several notches, wherein the first internal thread has thread pitch that is greater than the thread pitch of the second internal thread, and wherein the core receiving and guide part has a radially running collar with a shape that is matched to the thread profile of the second internal thread and interacts with the second internal thread, and wherein the core receiving and guide part has a tension relief and sealing region which faces the union nut and which has several annularly arranged plates, and wherein the radially running collar is located on a side of the tension relief and sealing region which faces away from the union nut, a device connecting component;

wherein the device connecting component has a connection body with an external thread and a clamping and connection unit with insulation piercing connecting devices, and with connection elements, wherein the insulation piercing connecting devices are adapted to dip into the notches in the core receiving and guide part when the union nut is screwed onto the external thread of the connection body for making contact with a conductor of a cable being connected.

10. A cable joining apparatus for electrically conductive joining of two cables, comprising:

a cable connection component having:

a union nut which has a first internal thread and a second internal thread, and a core receiving and guide part which has several notches, wherein the first internal thread has thread pitch that is greater than the thread pitch of the second internal thread, and wherein the core receiving and guide part has a radially running collar with a shape that is matched to the thread profile of the second internal thread and interacts with the second internal thread, and wherein the core receiving and guide part has a tension relief and sealing region which faces the union nut and which has several annularly arranged plates, and wherein the radially running collar is located on a side of the tension relief and sealing region which faces away from the union nut, a cable joining component, the cable joining component having a connection body with an external thread and a clamping and connection unit with insulation piercing connecting devices and with connection elements, wherein the insulation piercing connecting devices are adapted to dip into the notches in the core receiving and guide part when the union nut is screwed onto the external thread of the connection body for making contact with a conductor of a cable being connected.

* * * * *